US005836245A

United States Patent [19]

Bolza-Schünemann

[11] Patent Number: 5,836,245

[45] Date of Patent: Nov. 17, 1998

[54] DRIVE FOR A MULTI-COLOR WEB-FED ROTARY PRINTING PRESS

[75] Inventor: Claus August Bolza-Schünemann, Würzburg, Germany

[73] Assignee: Koenig & Bauer-Albert Aktiengesellschaft, Wurzburg, Germany

[21] Appl. No.: 356,227

[22] PCT Filed: Jun. 18, 1993

[86] PCT No.: PCT/DE93/00525

§ 371 Date: Dec. 19, 1994

§ 102(e) Date: Dec. 19, 1994

[87] PCT Pub. No.: WO94/00297

PCT Pub. Date: Jan. 6, 1994

[30] Foreign Application Priority Data

Jun. 19, 1992 [DE] Germany ..... 42 19 969.7

[51] Int. Cl.[6] ..... B41F 5/08; B41F 5/12; B41F 5/16

[52] U.S. Cl. ..... 101/181

[58] Field of Search ..... 101/181, 183, 101/220, 228, 219, 178, 179, 180–185, 136–140, 142–145

[56] References Cited

U.S. PATENT DOCUMENTS

| | | | |
|---|---|---|---|
| 1,640,977 | 8/1927 | Brueshaber | 101/181 |
| 1,970,491 | 8/1934 | Crafts | 101/216 X |
| 2,022,696 | 12/1935 | Tomlin | 101/216 X |
| 2,673,315 | 3/1954 | Seeger . | |
| 3,221,651 | 12/1965 | Tagliasacchi . | |
| 4,240,346 | 12/1980 | Landis | 101/177 X |
| 5,341,735 | 8/1994 | Hajek . | |

FOREIGN PATENT DOCUMENTS

| | | |
|---|---|---|
| 5946086 | 11/1930 | Germany . |
| 975 145 | 9/1961 | Germany . |
| 24 06 509 | 8/1975 | Germany . |
| 30 31 714 | 7/1982 | Germany . |
| 31 12 775 | 10/1982 | Germany . |
| 33 18 250 | 11/1984 | Germany . |
| 27 58 900 | 5/1987 | Germany . |
| 37 02 327 | 8/1988 | Germany . |
| 41 27 321 | 2/1993 | Germany . |

*Primary Examiner*—J. Reed Fisher
*Attorney, Agent, or Firm*—Jones, Tullar & Cooper, P.C.

[57] ABSTRACT

A multi-color web-fed rotary printing press is arranged having a plurality of printing groups with each group having several individual printing units. Each printing group has an upright drive shaft that is connected to a drive motor for each of the several printing units in the group. The several upright drive shafts are connected to a longitudinal main drive shaft. The individual drive motors and the upright shafts are sized to be able to take over the drive of one of the printing units in a printing group should its motor fail.

1 Claim, 2 Drawing Sheets

DRIVE FOR A MULTI-COLOR WEB-FED ROTARY PRINTING PRESS

FIELD OF THE INVENTION

Drive for a Multi-Color Web-Fed Rotary Printing Press

DESCRIPTION OF THE PRIOR ART

The invention relates to a drive for a multi-color web-fed rotary printing press.

A web-fed rotary printing press with several inking units and a folding unit is known from DE-OS 31 12 775, wherein a drive shaft, driven by a main motor, is provided and is connected via upright shafts with the printing units.

It is disadvantageous here that the entire printing operation is stopped when the main drive motor fails. It is furthermore disadvantageous that, because of the disconnection of printing units not needed for reasons of production, it becomes necessary to switch on current limiting device in order to prevent too great a brush wear of the electric motor.

SUMMARY OF THE INVENTION

It is the object of the invention to provide an easy-to-synchronize drive for a multi-color web-fed rotary printing press having an output which is adapted to the given production requirements, by means of which printing units which are not needed temporarily can either be turned off or operated for cleaning and preparation work.

A drive for a multi-color web-fed rotary printing press employs a main shaft and several upright shafts. Several printing units, which are disposed above each other to form printing groups, each have a separate drive motor and are each connected by a clutch and a gear to one of the upright shafts. Each of the upright shafts, as well as folding units which are driven by their own separate motors, are connected through clutches to the longitudinal main shaft.

The following advantages in particular ensue when employing the invention. By means of the assignment of one drive motor to a printing unit it is possible to disconnect it separately from the drive system when necessary and in this way to adapt the drive output to the given production requirements. Current limiting devices for a main motor, which were necessary up to now, can be omitted. For cleaning, maintenance or pre-inking work at the printing cylinders it is furthermore possible to run the printing unit by means of the respectively assigned drive motor without producing anything. In case of the loss of a motor driving a printing unit, is possible to obtain the power for running a printing unit via the upright shaft, i.e. the motors and shafts are of such size that they can also provide the output of a failed motor. Connection of a printing unit to the synchronized or upright shaft is provided with small outlay via a clutch, wherein synchronization is provided by means of an absolute value transmitter or a positive clutch. A simple seating possibility is provided because the drive motors are alike.

Possible separate auxiliary motors, which were possibly used up to now for washing, setting-up or positioning, can therefore also be omitted.

BRIEF DESCRIPTION OF THE DRAWINGS

The invention will be explained in detail below by means of an exemplary embodiment. The associated drawings show in FIG. 1, a front view of a multi-color web-fed rotary printing press with a drive diagram.

DESCRIPTION OF THE PREFERRED EMBODIMENT

Figure 1:
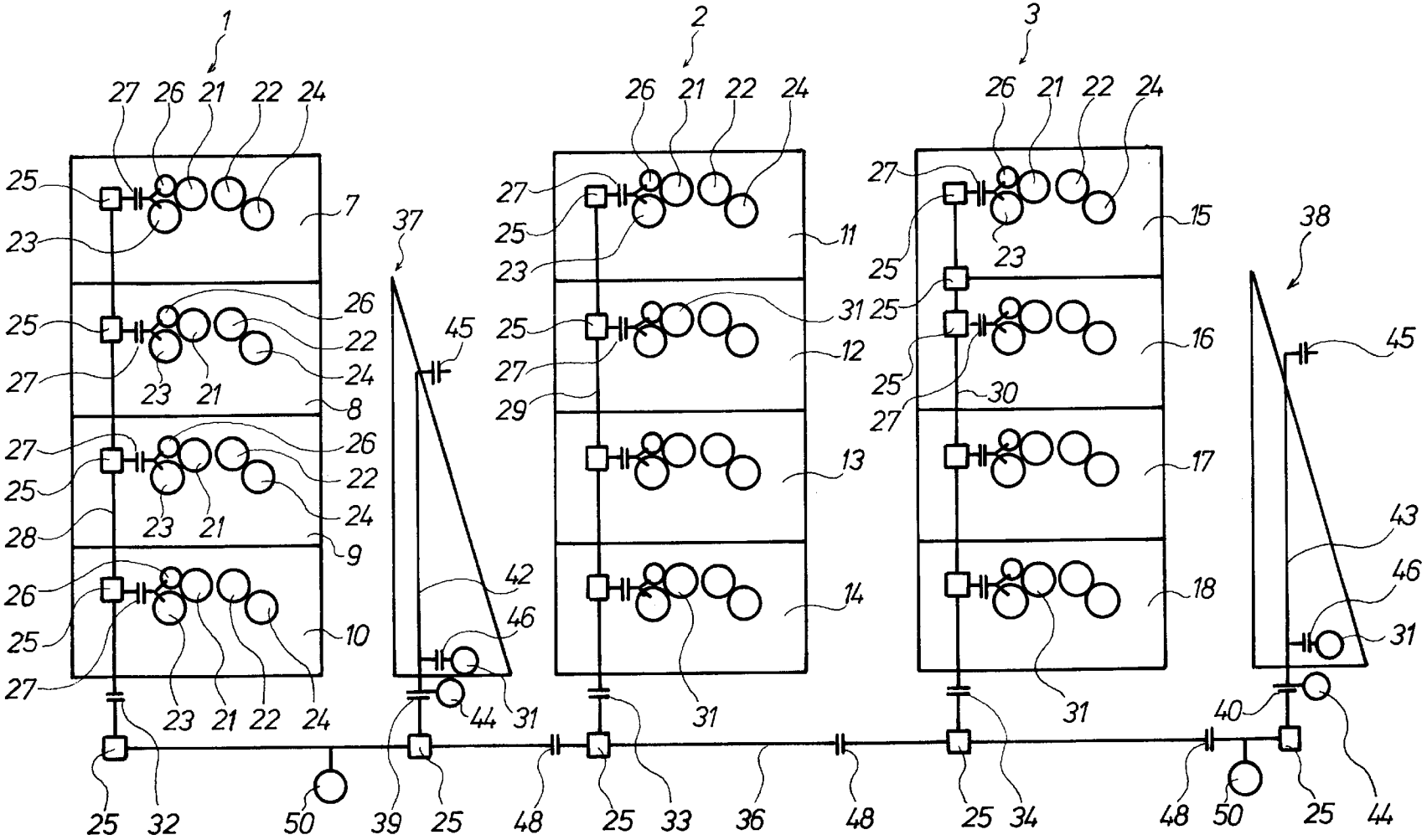

Three identical printing groups 1, 2, 3, so-called towers of eight, are represented in FIG. 1, which each have four printing units 7 to 18 disposed on top of each other. Each printing unit 7 to 18 has respectively two rubber blanket cylinders 21, 22 as well as two plate cylinders 23, 24. The plate cylinder 23 of each printing unit 7 to 18 is driven by a motor 26. The rubber blanket and plate cylinders 21 to 24 are respectively connected with each other by means of known toothed gears. Each one of the printing units 7 to 18 is connected via a clutch 27, a beveled toothed gear 25, a synchronizing or upright shaft 28, 29 or 30, an upright shaft clutch 32, 33 or 34 and a beveled toothed gear 25 with a synchronizing or longitudinal shaft 36. The clutches 27, 32 33, 34 can be known clutches in good register and can consist of an upper and a lower clutch plate. The rubber blanket cylinder 21 of each printing unit 8, 10, 12, 14 16 and 18 is provided with an absolute value transmitter 31 (AWG) which by known electronic means signals only one possible angle position of the driven rubber blanket cylinder 21 for synchronized connection of the printing unit. The absolute value transmitter consists of a circular disk with angular graduation. It is also possible to use a known so-called positive clutch in place of the absolute value transmitter, which also permits the connecting process in only one possible angular position.

Two folding units 37, 38 are also connected via beveled toothed gears 25 as well as with upright shaft clutches 39, 40 and upright shafts 42, 43 with the synchronizing or longitudinal shaft 36.

Each folding unit 37, 38 can be driven by a motor 44. Forming rollers, not shown, are respectively connected with the upright shaft 42, 43 of the folding unit 37, 38 via clutches 45 and transverse shafts, not shown, for the fold are respectively connected with it via clutches 46. Each transverse shaft for the fold is suitably connected with an absolute value transmitter 31. For the purpose of synchronization with the printing groups 1 to 3, each upright shaft 42, 43 of the folding unit 37, 38 is connected via a known beveled toothed gear 25 with the longitudinal shaft 36.

The longitudinal shaft 36 can be embodied to be divided by means of several clutches 48 of known construction. Further printing groups, not shown, can also be connected with the longitudinal shaft 36. The divided longitudinal shaft 36 can be brought into a synchronized position by means of absolute value transmitters 50 (WIG).

The printing units 7 to 18 can also be embodied in a Y-shape, i.e. each one with three rubber blanket cylinders and three plate cylinders. However, in this case only two printing units are disposed above each other for practical reasons.

Figure 2:
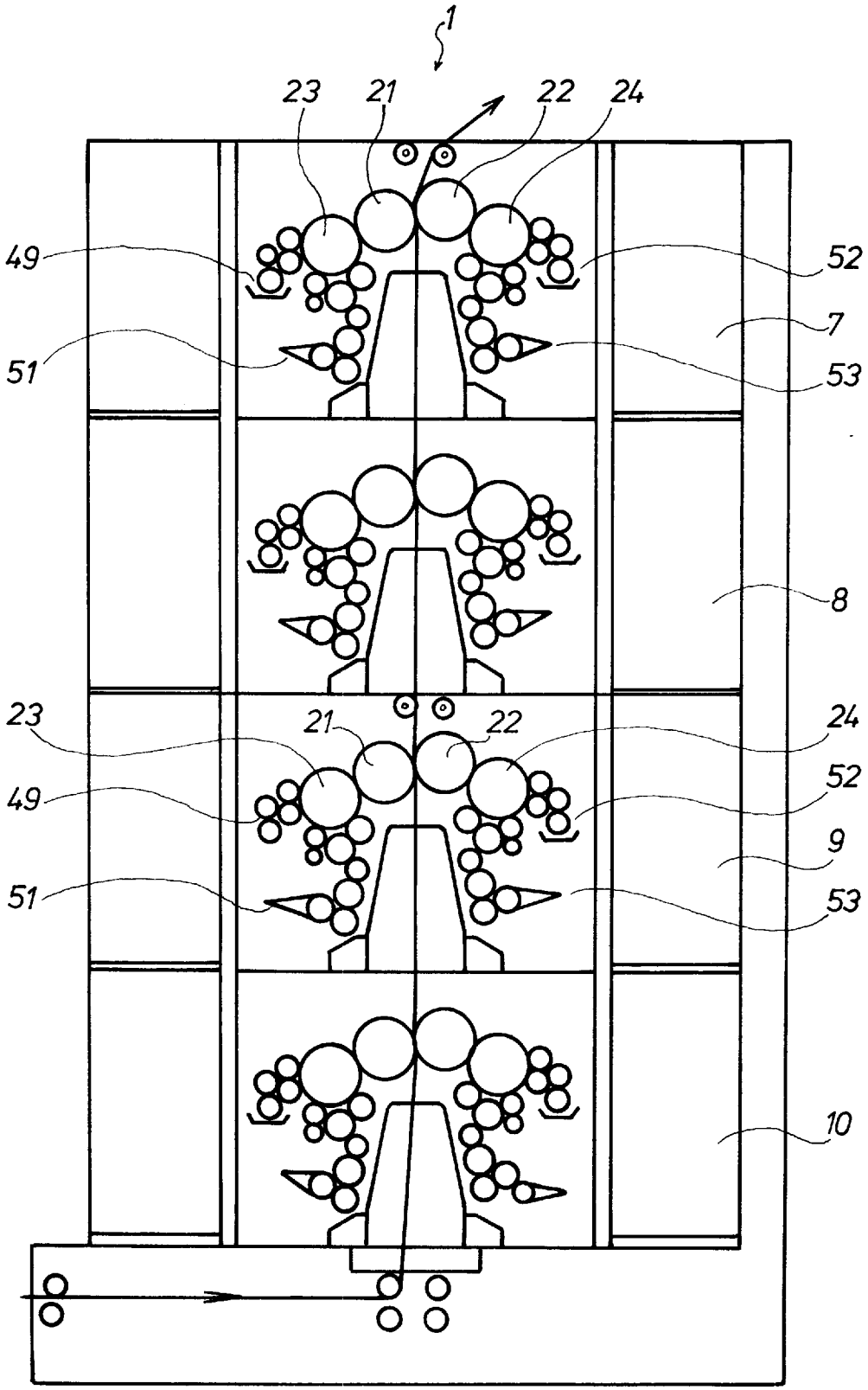
FIG. 2, an enlarged representation of a printing group of FIG. 1, but without showing the drive.

The enlarged representation of a printing group 1, having inking and dampening units, is shown in FIG. 2, but without a representation of the drive. The printing units 7 to 10, disposed above each other, are shown, wherein respectively one dampening unit 49 and one inking unit 51 are associated with and driven by the plate cylinders 23, and respectively one dampening unit 52 and one inking unit 33 are associated with and driven by the plate cylinders 24. The upright and longitudinal shafts 28 to 30, 36, 42,-43 are seated in respective bearings fixed on the frame.

I claim:

1. A drive for a multi-color web-fed rotary printing press comprising:

a plurality of printing groups with each of said printing groups having at least two individual printing units disposed one above the other;

an individual printing unit drive motor for each one of said individual printing units in each one of said plurality of printing groups;

at least first and second folding units, each having a separate folding unit drive motor;

a separate upright shaft positioned adjacent each one of said plurality of printing groups and each of said at least first and second folding units, each said upright shaft having an upright shaft clutch;

a separate coupling clutch and bevel gear connecting each individual printing unit in each one of said plurality of printing groups to said separate upright shaft associated with said one of said plurality of printing groups; and a main synchronizing drive shaft extending longitudinally and being connected to each one of said upright shafts for said plurality of printing groups and said at least first and second folding units through said shaft clutches, each of said individual printing unit drive motors being separately disconnectable from its associated one of said upright shafts, each said individual printing unit drive motor having an output sufficient to operate another one of said printing units in the one of said printing groups in which it is located upon failure of another one of said individual printing unit drive motors in the one of said printing groups in which said individual printing units are located.

* * * * *